US006216287B1

(12) United States Patent
Wise

(10) Patent No.: US 6,216,287 B1
(45) **Date of Patent: *Apr. 17, 2001**

(54) SHOWER CURTAIN ROD

(75) Inventor: Dick A. Wise, Kingwood, TX (US)

(73) Assignee: Sean Moore, Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 521 days.

(21) Appl. No.: 08/739,888

(22) Filed: Oct. 31, 1996

Related U.S. Application Data

(63) Continuation-in-part of application No. 08/497,855, filed on Jul. 3, 1995, now abandoned.

(51) Int. Cl.[7] ..... A47K 3/38
(52) U.S. Cl. ..... 4/610
(58) Field of Search ..... 4/610, 558, 608

(56) References Cited

U.S. PATENT DOCUMENTS 2,778,030 * 1/1957 Goche ..... 4/610 X
3,107,361 * 10/1963 Glutting, Sr. ..... 4/558
3,557,390 * 1/1971 Ruggles et al. ..... 4/584
5,103,531 * 4/1992 Perrotta ..... 4/608 X

* cited by examiner

*Primary Examiner*—Robert M. Fetsuga
(74) *Attorney, Agent, or Firm*—Bracewell & Patterson L.L.P.

(57) ABSTRACT

The present disclosure sets forth an improved shower curtain rod. It is adapted for use with a enclosure defined by left and right end walls, and a back splash wall defining a bath tub enclosure above a bath tub. The bath tub is oval or elliptical and fits in an oval and elliptical hole in a horizontal deck. The shower curtain rod of the present disclosure has ends connected with a curving middle portion which ends are anchored at end fittings. There is, between the two ends, a curving portion which conforms with an oval or elliptical bath tub shape.

9 Claims, 1 Drawing Sheet

SHOWER CURTAIN ROD

Figure 1:
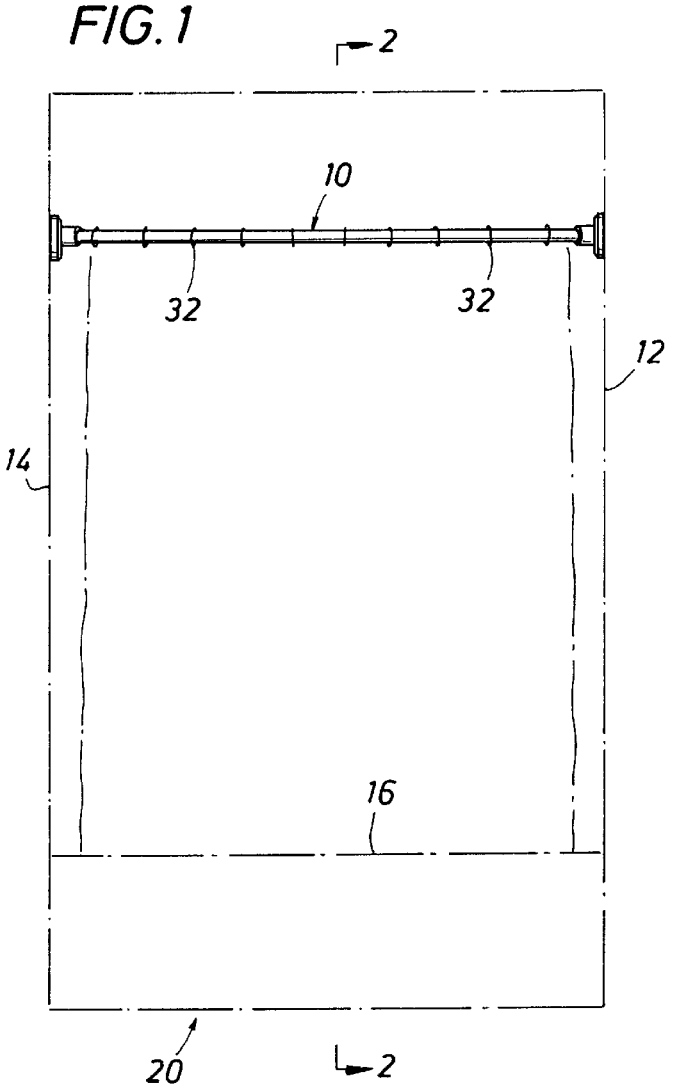

The present disclosure is a continuation-in-part of application Ser. No. 08/497,855 which was filed on Jul. 3, 1995 and which application has now been abandoned.

BACKGROUND OF THE DISCLOSURE

The present disclosure is directed to a shower curtain rod and more particularly to a shower curtain rod which is shaped and profiled to fit above and in cooperation with a particular type shower or tub construction. It is intended to be used to support a shower curtain to prevent water from splashing out of the enclosure bordered by the shower curtain as the curtain is draped into a bath tub below the curtain rod.

In the construction of most bathrooms, it is common to position a shower nozzle mounted on the wall at an enclosure above a bath tub to thereby provide the option of a shower for the resident using the bathroom facility. In defining such enclosures, splashing water out of the enclosure is limited by the use of a sliding door, typically a translucent plastic or shatter proof glass, or more conveniently, a shower curtain. The shower curtain is ordinarily constructed and arranged to drape loosely from a set of eyelets or curtain rings which slide along the curtain rod. A set of such rings is normally mounted slidably on the shower curtain rod which is positioned normally at the height of the sprinkler head or other nozzle. The shower curtain is draped in the bath tub below so that water is not splashed out of the bath tub. Because the bath tub is below the shower nozzle, the bath tub functions to collect water which drains from the bath tub during the shower. In this particular instance, the shape of the bath tub may well cause the shower curtain to drape in such a fashion that some of the splashed water will not be captured within the curtain, maintained on one side of the curtain, and directed into the bath tub for drainage. The present disclosure provides a shower curtain rod which is shaped so that the bathroom is assuredly protected by draping the shower curtain in such a way that splashed water does not escape from the bath tub. The present disclosure is particularly adapted for use with oval or elliptical shaped bath tubs. The rod of this disclosure extends from the end walls defining the tub enclosure and over the curving front edge of the oval tub so that the alignment of the shower curtain is directed into the tub to avoid water splash.

Many bath tubs, indeed most bath tubs are constructed with a straight exposed side. Straight side bath tubs are constructed so that they can be positioned immediately below a straight shower rod. In the use of a straight shower rod, the drape of the shower curtain is fairly well defined by the support provided overhead by the shower rod. Since the shower rod is straight, the bath tub itself defines a companion or parallel, perhaps slightly inset, opening where the loosely hanging shower curtain can be directed. In that event, the shower curtain is positioned so that all of the splashed water is maintained in the bath tub. In a rectangular bath tub, this is accomplished through the use of a straight shower curtain rod. One example of this is set forth in U.S. Pat. No. 5,022,104. This patent shows a straight sided bath tub where the shower rod is provided with a central straight portion having a length approximately equal to that of the bath tub and which also includes offset end rod portions which enable connection with the tile wall which surrounds the bath tub. In that construction, the bath tub is positioned below the rod so that the shower curtain can drape in the tub.

This reference sets forth the requisite overhead rod having a straight length portion with end portions which approximately conform to the length or profile of the bath tub when viewed from above.

The present disclosure cooperates with a bath tub constructed with an overhead curtain rod to hang or drape a shower curtain in an oval shaped bath tub. The improved shower curtain rod contrasts markedly with that of the conventional tub profile. The shower curtain rod, when viewed from above, has a curving portion which conforms with the curvature of the bath tub. Since the bath tub is an oval or is elliptical in shape, the shower rod has a portion which matches that curvature and is located the requisite distance above the bath tub so that the shower curtain, hanging loosely from the rod on a set of rod hangers, drapes into the tub and prevents splashed water from escaping from the bath tub around the ends of the curtain.

The present disclosure is therefore summarized as a shower curtain rod having two end portions with angled fittings to enable the shower curtain rod to be attached between a pair of parallel walls at a bath tub enclosure. The shower curtain rod is constructed with a central portion curving to follow the edge or profile of an oval or elliptical bath tub. This curving central portion enables the shower curtain to hang into the bath tub. When positioned above the bath tub, the shower curtain rod of the present disclosure is particularly useful to deflect splashed water into the tub by enabling a user to simply slide the shower curtain along the length of the shower curtain rod so that it hangs into the tub therebelow.

In particular, the curving rod is provided with a curve that in the preferred embodiment provides curvature at a radius of about 4'. This provides a rod of total length of about 5'1". The curving portion is preferably about 40" to 45" in length. The two end portions (tangential to the curved portion) are equal in length and are about 6" to 10" in length. As will be understood, the 4' radius of curvature enables the curved shower curtain rod to approximately coincide with the marginal edge of the bath tub when spaced thereabove. This curvature is highly desirable to match the bath tub below so that the shower curtain drapes appropriately in the bath tub. The end support brackets accommodate the angle of the rod so that bracket faces abut the end walls while supporting the curved shower curtain rod.

IN THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

Figure 2:
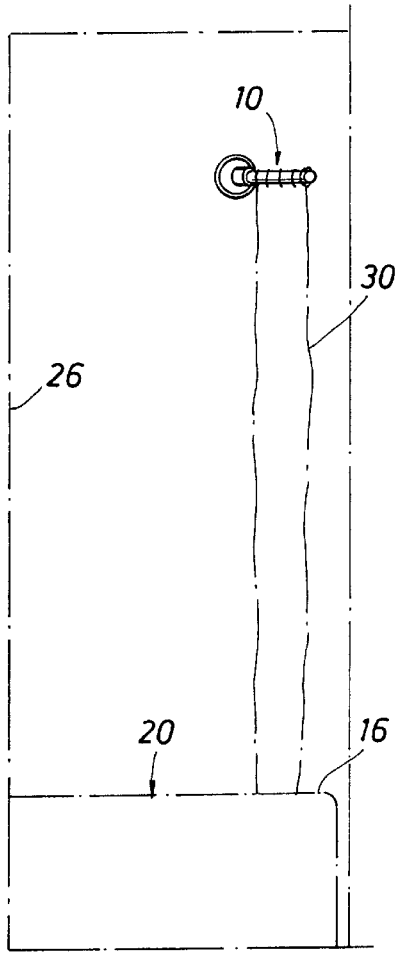
Figure 3:
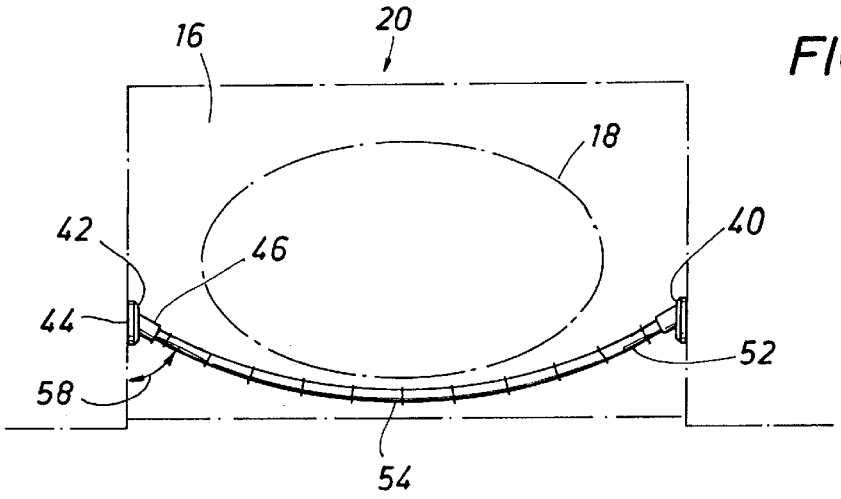

FIG. 1 of the drawings shows a shower curtain rod positioned above a bath tub in accordance with the teachings of the present disclosure and additionally sets forth the position of the shower curtain hanging from the shower curtain rod so that the lower end of the shower curtain is in the tub;

FIG. 2 is a sectional view along the line 2—2 of FIG. 1 showing the shower curtain rod extending in a curving fashion to support the shower curtain therebelow for draping appropriately in the bath tub, and also shows a wall mounting member; and FIG. 3 is a plan view of the bath tub of the present disclosure also showing the position of the shower curtain rod with respect to the shape or profile of the bath tub.

DETAILED DESCRIPTION OF THE PREFERRED EMBODIMENT

Attention is now directed to FIGS. 1 and 2 of the drawings considered jointly which show the shower curtain rod of the present disclosure installed in and positioned above a bath tub. More specifically, the numeral 10 identifies the shower curtain rod of the present disclosure which is installed between a pair of facing walls 12 and 14 which form an enclosure about a horizontal deck 16 which has a central opening 18 which defines the bath tub 20. The bath tub 20 is oval or elliptical in profile. The bath tub 20 is constructed in accordance with industry standards so that it has a depth typically between about 12 and 24 inches, the norm being about 20", and is provided with a drain and an appropriate hot and cold faucets (not shown for sake of clarity). The bath tub 20 is formed as a recess or cavity below the deck 16 so that the recessed region forms a suitable bath tub which can be optionally used either as a bath tub or a basin into which shower water might be splashed. A shower is obtained from an overhead nozzle (not shown) is located so that it directs water spray downwardly for the convenience of those who prefer a shower to a bath.

More specifically, the context in which the shower rod 10 is installed involves the sidewalls 12 and 14 which are typically formed either of plastic sheetrock or tile to deflect splashed water toward the tub 20. It is not uncommon to define the shower stall by incorporating a back wall 26. The walls 12, 14 and 26 are typically formed as a unit at the time of construction and the deck 16 is installed to define the lower portions thereof. This is a shower stall which is closed by a shower curtain 30 which hangs in multiple folds from a set of shower curtain rings 32. The rings 32 are positioned loosely on the overhead shower curtain rod 10. The rings 32 enable the shower curtain to slide to an open position where the shower curtain 30 is bunched at one end or the other of the enclosure, or the shower curtain spans the enclosure, effectively providing a movable wall which is more or less spaced from the back wall 26 and which movable wall extends between the end walls 12 and 14, thereby completing the enclosure so that water is not splashed out of the area.

The deck 16 typically has dimensions of approximately 40" by 60". It is not uncommon to make the deck 16 somewhere between about 40 and 48 inches deep, and to extend the deck in length between about 60 and 84 inches. The oval shaped tub 20 has a profile which is especially attractive to many. In particular, this oval shape, perhaps defined as an ellipse by some, is a suitable drain basin when used as a shower. Thus, water is delivered through the nozzle in the customary fashion and is directed into the basin defined by the bath tub 20. In this particular instance, it is possible that water will splash out of the area and wet the adjacent floor. When the shower curtain 30 is pulled across the tub, that will stop splashing and restrain wetting of the near vicinity.

Focusing especially on the present invention, this disclosure sets forth the improved shower rod 10 which is fastened between the end walls of the enclosure. It is fastened to the walls 12 and 14 by the use of an anchored rod mounting plate 40 better shown in FIG. 3 of the drawings. The rod anchor has a circular lip 42. This enables the back face 44 to be adhesively joined to or otherwise anchored on the enclosure end walls 12 and 14. The rod anchor is anchored to support an upstanding and angled post 46 which has the form of a hollow cylinder to connect to the end of the shower rod 10. The rod and cylinder 46 join at a plug and socket. The cylinder 46 has a length of perhaps about two inches or so. The end of the cylinder 46 is the hollow cavity to plug to the end of the curtain rod 10. The fitting 40 is anchored and prevented from rotating by anchoring the plate 40 on the wall. The mounting plate 40 locks the shower rod 10 (after installation) to prevent movement or rotation. Once the plate 40 is installed, the rod 10 is held in a desired angular position which is important to its daily use. The shower rod 10 is fixedly locked or clamped between the two plates 40 to be held in a plane located parallel to and above the tub 20 in the fashion show in the FIGS. 1 and 2 as is described in the present disclosure.

In FIGS. 1 and 2 considered jointly, the shower rod 10 is preferably formed either of a hollow metal tube or a hollow rigid plastic. Composite materials can likewise be used. It is preferably hollow to reduce weight and reduce the amount of material required for the shower rod 10. The rod 10 is curved between the two rod end portions 50 and 52. The ends 50 and 52 are symmetrical and are also tangential to the central curved portion as noted in FIG. 3 of the drawings. Between the ends 50 and 52, there is a curving portion 54. The central curving portion 54 comprises most of the length of the shower curtain rod. The curving portion 54 is located when installed to coincide with the curvature of the oval or elliptical tub 20. The curving portion 54 is therefore defined by conformance with the side profile or shape of the tub 20. As shown in the plan view of FIG. 3, between the ends 50 and 52, the curving portion 54 is approximately a segment of an oval. This oval segment matches the oval shape of the tub 20. Preferably, the oval segment 54 is installed so that it is in line with and slightly out board of the tub 20 as shown in FIG. 3. In other words, it is located parallel to the side of tub 20 so that the curtain 30 will hang nearly straight down and fall into the tub 20. This is true whether the curtain is bunched at one end or is deployed fully along the curvature 54 so that the whole curtain 30 drapes into the tub 20. It is not necessary for the curtain 30 to hang to the bottom of the tub. It is highly desirable that the shower curtain have a length enabling the lower marginal edge to hang into the tub 20. This assures that the water trickling down the side of the shower curtain will run into the tub.

The shower curtain rod 10 is installed above the bath tub by positioning the fittings 40 against the walls 12 and 14. The fittings are typically about 8 inches offset from the centerline axis of the tub. While the location of the fittings can be varied somewhat, it is desirable that the fittings 40 hold the shower rod 10 in a location enabling the curving portion 54 to fit above and conformed to the curvature of the tub as shown in FIG. 3 of the drawings. More specifically, one of the fittings 40 is first installed so that thereafter the shower rod is positioned. The second fitting is installed then. It is desirable that the shower rod flex every so slightly to enable the shower rod to be caught between the two fittings. In accomplishing this, the curvature 54 is pre-bent into the rod and assists in conforming the rod to the tub profile. The rod is typically resilient and has a spring like nature causing the shower rod 10 to straighten slightly when free of the two fittings. The rod is fixed in position so that the curvature 54 is substantially in a plane which is parallel to the deck 16 and which is also horizontal. This is better depicted in FIG. 2 of the drawings. The length of the curvature 54, the angular extent of that curvature, and the position of the curvature with respect to the tub is illustrated in the best mode in FIG. 2 of the drawings. This positions the rod so that the curvature of the shower curtain rod dictates and controls the location at which the shower curtain 30 hangs into the tub 20.

In the preferred embodiment, the aggregate length of the rod in a straight condition is about 60" to 66". This is comprised of about 70% to 90% of curving portion with two equal length end portions 50 and 52 which are straight. The straight end portions direct the rod straight into the fittings 40 which enables the rod to be positioned substantially horizontally and above the deck 16. Using a 4' radius with a rod of about 60" to 63" in length, the fittings 40 thus defined an angle 58 which is in the range of about 30° to 75°. Both end fittings are provided with the same angle. If the curving portion 54 has a tighter radius, that might be achieved by bending around a 3' radius, then the defined angle is somewhat smaller, perhaps as small as 45°. As a generalization, it is desirable to make the radius of curvature appropriate so that the curving portion 54 approximately follows the edge of the tub 20. By doing that and providing straight end portions, the rod can be installed approximately parallel to the edge of the tub to thereby cause the shower curtain to drape into the tub to assure that water does not splash out of the tub at the ends of the curtain. If anything, the shower curtain is deflected ever so slightly because it does not hang perfectly vertically; the slight angle shown for the shower curtain in FIG. 2 assures that splash out of the tub is held to a minimum.

While the foregoing is directed to the preferred embodiment, the scope thereof is determined by the claims.

What is claimed is:

1. A shower curtain rod for hanging and supporting the weight of a shower curtain and comprising an elongate rod having first and second spaced end portions defining an angle therebetween, wherein said end portions are fixed in location above a bath tub by end receiving fittings, and wherein said rod defines one smooth continuous curve between said end portions, and said fittings are supported on a pair of parallel walls located at opposite ends of said bath tub, and said fittings comprise:

(a) a back plate attached to said wall;

(b) a protruding rod connector with a major axis, wherein said connector is a protruding hollow cylinder to fit around said rod and is slidingly adjustable with the rod; and (c) said major axis of said protruding rod connector is horizontal and is angled with respect to said wall to form an angle with an opposed rod connector that is the same as the angle between the end portion of the rod; wherein said fittings (d) support said rod elevated above the bath tub at a height and in a horizontal plane to define a shower enclosure; and said shower curtain rod has said two end portions and a curving portion conforming to a portion of the curvature of the bath tub therebelow to enable a curtain hanging from the rod to drape into the tub.

2. The apparatus of claim 1 wherein said bath tub is an opening formed in a horizontal deck and the opening is oval and said shower curtain rod conforms to a forward edge of the tub oval to enable a shower curtain to drape thereinto to prevent splashing water during showers by a user from the bath tub and said curving portion is an arc of an oval or circle having a radius of at least about 4', and said end portions are at least about 6" in length.

3. The apparatus of claim 2 wherein said shower curtain rod is a hollow round rod able to support a set of shower curtain rings therein to deploy a shower curtain.

4. The apparatus of claim 3 wherein said curving portion conforms to one side of the bath tub.

5. The apparatus of claim 2 wherein said end fittings secure said rod in a horizontal plane.

6. The apparatus of claim 5 wherein said rod is hollow.

7. The apparatus of claim 2 wherein said major axis of said protruding rod connector is angled between about 30° and 66° to curve said rod after mounting said rod on said fittings.

8. The apparatus of claim 7 wherein said connector is a protruding hollow cylinder to fit around said rod.

9. The apparatus of claim 7 wherein said connector is axially hollow and fits over said rod end.

* * * * *